US011078013B2

(12) United States Patent
Factor

(10) Patent No.: US 11,078,013 B2
(45) Date of Patent: Aug. 3, 2021

(54) TRASH CONTAINERS

(71) Applicant: Pail Pal Inc., Staten Island, NY (US)

(72) Inventor: Karen Factor, Staten Island, NY (US)

(73) Assignee: PAIL PAL INC., Staten Island, NY (US)

( * ) Notice: Subject to any disclaimer, the term of this patent is extended or adjusted under 35 U.S.C. 154(b) by 547 days.

(21) Appl. No.: 15/113,584

(22) PCT Filed: Jan. 27, 2015

(86) PCT No.: PCT/US2015/013015
§ 371 (c)(1),
(2) Date: Jul. 22, 2016

(87) PCT Pub. No.: WO2015/113022
PCT Pub. Date: Jul. 30, 2015

(65) Prior Publication Data
US 2017/0001797 A1 Jan. 5, 2017

Related U.S. Application Data

(60) Provisional application No. 61/931,896, filed on Jan. 27, 2014.

(51) Int. Cl.
*B65F 1/06* (2006.01)
*B65F 1/14* (2006.01)
*B65F 1/16* (2006.01)

(52) U.S. Cl.
CPC ..... *B65F 1/062* (2013.01); *B65F 1/141* (2013.01); *B65F 1/1623* (2013.01); *B65F 1/1646* (2013.01); *B65F 1/1615* (2013.01); *B65F 2001/1653* (2013.01); *B65F 2001/1676* (2013.01); *B65F 2220/128* (2013.01); *B65F 2230/00* (2013.09); *B65F 2230/116* (2013.01)

(58) Field of Classification Search
CPC ..... B65F 1/062; B65F 1/141; B65F 1/1421; B65F 1/1646; B65F 1/004; B65F 1/0033; B65F 1/0053; B65F 1/08; B65F 1/16
USPC ..... 220/501, 505, 520, 909, 908, 475, 23.86
See application file for complete search history.

(56) References Cited

U.S. PATENT DOCUMENTS 3,392,868 A * 7/1968 Pfrommer ..... A45D 33/22 220/4.27
5,067,626 A * 11/1991 Leumi ..... B65F 1/12 220/475
5,441,163 A * 8/1995 Carrasco ..... B25H 3/00 206/373
5,458,259 A * 10/1995 Falk ..... B65F 1/062 221/22
5,645,186 A 7/1997 Powers et al.
D393,504 S 4/1998 Eisman
(Continued)

FOREIGN PATENT DOCUMENTS

WO WO2006078448 7/2006

OTHER PUBLICATIONS

International Search Report and Written Opinion dated Aug. 28, 2015 in related International Application No. PCT/US15/13015 filed Aug. 28, 2015 (7 pages).

*Primary Examiner* — Robert Poon
(74) *Attorney, Agent, or Firm* — Gottlieb, Rackman & Reisman, PC

(57) ABSTRACT

An accessory comprises a clamp configured for clamping onto the transport device frame and a trash container coupled to the clamp.

18 Claims, 10 Drawing Sheets

(56) References Cited

U.S. PATENT DOCUMENTS

| | | | | |
|---|---|---|---|---|
| 5,881,900 | A * | 3/1999 | Meshorer | B65F 1/062 220/495.07 |
| 6,199,737 | B1 | 3/2001 | Ringelstetter | |
| 6,257,473 | B1 | 7/2001 | Ringelstetter | |
| 6,267,461 | B1 * | 7/2001 | Dunagan | A63B 47/002 312/49 |
| 6,283,321 | B1 | 9/2001 | Meshorer | |
| 6,454,119 | B1 * | 9/2002 | Demeur | A45F 5/02 220/475 |
| 6,766,930 | B2 | 7/2004 | Dixon et al. | |
| 6,971,697 | B2 | 12/2005 | Morales | |
| D515,264 | S | 2/2006 | Daams | |
| 8,312,599 | B2 | 11/2012 | Vogl et al. | |
| 8,376,200 | B2 | 2/2013 | Kim | |
| 9,701,469 | B1 * | 7/2017 | Reith | B65F 1/062 |
| 2004/0226850 | A1 | 11/2004 | Behnke et al. | |
| 2005/0199633 | A1 * | 9/2005 | Stanley | B65D 25/16 220/495.07 |
| 2006/0157548 | A1 | 7/2006 | Bastiani | |
| 2007/0272694 | A1 * | 11/2007 | May | B65D 83/08 220/495.07 |
| 2008/0149506 | A1 | 6/2008 | Kuo | |
| 2009/0230131 | A1 * | 9/2009 | McDuffie | B65F 1/06 220/495.06 |
| 2010/0282755 | A1 | 11/2010 | Kim | |
| 2011/0056173 | A1 * | 3/2011 | Ohnishi | B65F 1/062 53/389.2 |
| 2011/0284544 | A1 * | 11/2011 | Davies | B65F 1/1615 220/315 |
| 2012/0286003 | A1 | 11/2012 | Shadday et al. | |

* cited by examiner

TRASH CONTAINERS

CROSS-REFERENCE TO RELATED APPLICATIONS

The present application claims priority to International Application No. PCT/US15/13015 filed 27 Jan. 2015; which claims the benefit of U.S. Provisional Patent Application Ser. No. 61/931,896 filed 27 Jan. 2014, each of which is herein fully incorporated by reference for all purposes.

TECHNICAL FIELD

Generally, the present disclosure relates to trash management. More particularly, the present disclosure relates to trash containers.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure may be concerned with. Further, nothing is disclaimed.

A caretaker, such as a parent, a relative, or a babysitter, often walks around with a child in a stroller. During such walking, the child can generate trash, such as a used tissue, a food leftover, a soiled diaper, a dirty wet wipe, and so forth. In addition, during such walking, the caretaker can generate trash, such as a used tissue, a food leftover, a dirty wet wipe, and so forth. Moreover, during such walking, the caretaker can be responsible for another child outside of the stroller, such as a sibling of the child in the stroller, who can generate trash, such as a used tissue, a food leftover, a dirty wet wipe, and so forth. Furthermore, during such walking, the caretaker can be responsible for a pet who can generate trash, such as feces. Typically, the caretaker is unable to dispose of such trash readily. Therefore, the caretaker has several options.

One option for the caretaker is to abandon the trash on a ground surface. However, the caretaker can be fined by a law enforcement officer for littering. Additionally, the caretaker can be polluting a local habitat at least visually, such as during hiking. Furthermore, the trash can be harmful to local flora and/or fauna. Moreover, the caretaker can be contributing to an unaesthetic appearance of a neighborhood, which is undesirable by local residents. In addition, the caretaker can set a bad example for the child and bystanders.

Another option for the caretaker is to walk over with the stroller to a trash container to dispose of the trash. However, the container can be distal to the caretaker. Furthermore, the caretaker can be physically unable to walk to the container, such as if the container if positioned in an unsafe area. Moreover, the trash can be unsanitary and/or unpleasantly odorous. Additionally, the trash can be voluminous. Further, the stroller can prevent the caretaker from accessing the container, such as if the container is located on a rugged terrain.

Still another option for the caretaker is to place the trash into a stroller cup-holder until proximity to a trash container. However, the container can be distal to the caretaker. Furthermore, the caretaker can be physically unable to walk to the container, such as if the container is positioned in an unsafe area. Moreover, the trash can be unsanitary and/or unpleasantly odorous. In addition, the trash can be voluminous. Further, the caretaker can desire to use the cup-holder for another purpose, such as a containing a mobile phone, a beverage container, and so forth. Furthermore, the cup-holder can already be full of trash. Moreover, some strollers lack cup-holders.

Yet another option for the caretaker is to hold the trash until proximity to a trash container. However, the container can be distal to the caretaker. Furthermore, the caretaker can be physically unable to walk to the container, such as if the container if positioned in an unsafe area. Moreover, the trash can be unsanitary and/or unpleasantly odorous. Additionally, the trash can be voluminous. Further, the caretaker can desire to use the caretaker's hand for other tasks, such as holding a mobile phone during a phone call, sipping from a beverage container, and so forth.

Yet still another option for the caretaker is to place the trash into a clothing pocket of the caretaker until proximity to a trash container. However, the container can be distal to the caretaker. Furthermore, the caretaker can be physically unable to walk to the container, such as if the container if positioned in an unsafe area. Moreover, the trash can be unsanitary and/or unpleasantly odorous. Additionally, the trash can be voluminous. Further, some clothing articles lack pockets.

Such concerns can arise for those who push car seat wheeled carriers, children's tricycles, or other forms of baby or child wheeled transport. Likewise, similar concerns can arise for those who push wheelchairs, hand trucks, walking frames, or shopping carts. Additionally, analogous concerns can arise for those who ride bikes, scooters, golf carts, or motorcycles.

Accordingly, a better way of dealing with the trash is desired.

SUMMARY

The present disclosure may at least partially address at least one of the above. However, the present disclosure may prove useful to other technical areas. Therefore, the claims should not be construed as necessarily limited to addressing any of the above.

According to an example embodiment of the present disclosure an accessory is provided. The accessory comprises a clamp and a trash container coupled to the clamp. The trash container comprises an upper compartment defined via an upper compartment base and an upper compartment sidewall extending from the upper compartment base. The upper compartment base and the upper compartment sidewall define an upper compartment interior chamber. The upper compartment base defines a slot therethrough. The trash container comprises a lower compartment defined via a lower compartment base and a lower compartment sidewall extending from the lower compartment base. The lower compartment base and the lower compartment sidewall define a lower compartment interior chamber. The trash container comprises a pivot extending along the upper compartment sidewall and the lower compartment sidewall such that at least one of the upper compartment and the lower compartment is able to pivot between an open position and a closed position. The upper compartment chamber is in fluid communication with the lower compartment chamber through the slot in the closed position. The lower compartment chamber is accessible over the lower compartment sidewall in the open position.

The present disclosure may be embodied in the form illustrated in the accompanying drawings. However, note that the drawings are illustrative. Variations are contemplated as being part of the disclosure, limited by the scope of the claims.

BRIEF DESCRIPTION OF THE DRAWINGS

The accompanying drawings illustrate example embodiments of the present disclosure. Such drawings are not to be construed as necessarily limiting the disclosure. Like numbers and/or similar numbering scheme can refer to like and/or similar elements throughout.

DETAILED DESCRIPTION OF THE PREFERRED EMBODIMENTS

Figure 1:
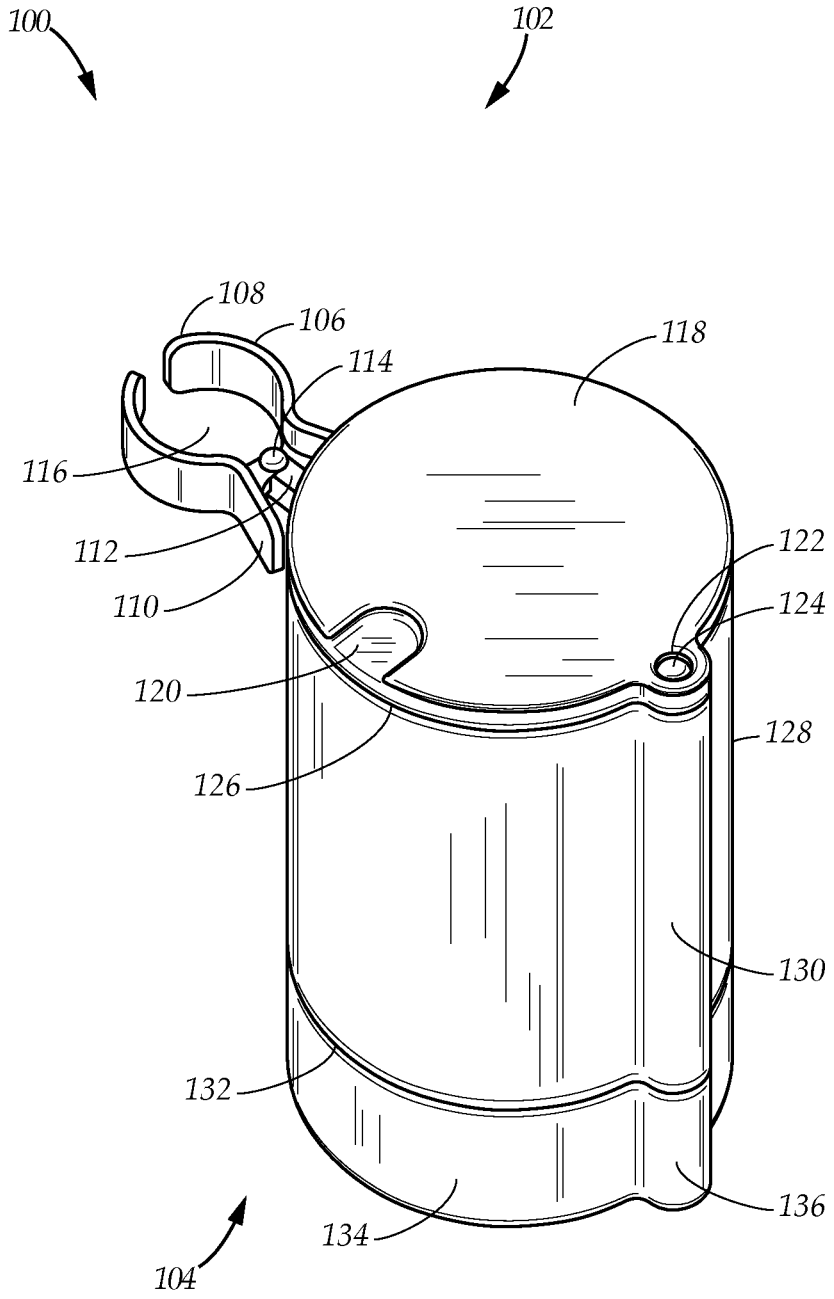
FIG. 1 shows a perspective view of an example embodiment of a clamp-equipped trash container according to the present disclosure.

The present disclosure is now described more fully with reference to the accompanying drawings, in which example embodiments of the present disclosure are shown. The present disclosure may, however, be embodied in many different forms and should not be construed as necessarily being limited to the example embodiments disclosed herein. Rather, these example embodiments are provided so that the present disclosure is thorough and complete, and fully conveys the concepts of the present disclosure to those skilled in the relevant art.

Features described with respect to certain example embodiments may be combined and sub-combined in and/or with various other example embodiments. Also, different aspects and/or elements of example embodiments, as disclosed herein, may be combined and sub-combined in a similar manner as well. Further, some example embodiments, whether individually and/or collectively, may be components of a larger system, wherein other procedures may take precedence over and/or otherwise modify their application. Additionally, a number of steps may be required before, after, and/or concurrently with example embodiments, as disclosed herein. Note that any and/or all methods and/or processes, at least as disclosed herein, can be at least partially performed via at least one entity in any manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer, or section discussed below could be termed a second element, component, region, layer, or section without departing from the teachings of the present disclosure.

The terminology used herein is for describing particular example embodiments only and is not intended to be necessarily limiting of the present disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

As used herein, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" may be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

As used herein, the term "about" and/or "substantially" refers to a +/−10% variation from the nominal value/term. Such variation is always included in any given value/term provided herein, whether or not such variation is specifically referred thereto If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

FIG. 1 shows a perspective view of an example embodiment of a clamp-equipped trash container according to the present disclosure. A clamp-equipped trash container 100 includes a clamp 102, a container 104, and a bridge 112 spanning therebetween. Clamp 102 includes a pivot 114, a pair of jaws 106 operably coupled to pivot 114, and a spring, which tensions jaws 106 for clamping onto a bar, such as a tubular stroller frame portion. Such tensioning is against bridge 112, but can also be against each other or pivot 114. The spring is a helical/coil spring, but can be a flat spring, and so forth. Note that more than one spring can be used. Bridge 112 spans from pivot 114 to container 104. Clamp 102, bridge 112, and/or container 104 can include metal, plastic, wood, rubber, and so forth. Note that clamp 102, bridge 112, and/or container 104 can be detachable from each other and/or non-detachable from each other.

Jaws 106 include a pair of clamping portions 108 and a pair of finger portions 110. Portions 108 extend from portions 110. Although portions 108 are unitary with portions 110, portions 108 can be assembled with portions 110, such as via fastening, mating, locking, welding, gluing, magnetizing, interlocking, and so forth.

Portions 108 are U-shaped, but can be shaped differently for clamping, such as a V-shape, a Y-shape, an L-shape, a J-shape, an H-shape, an F-shape, an S-shape, an M-shape, an N-shape, a C-shape, an X-shape, a Z-shape, and so forth. Portions 108 can include a material to enhance clamping, such as a magnet, a rubber strip, a hook-and-loop fastener, and so forth. For example, such material can be a rectangular strap extending in an arcuate manner along an inner surface of one of portions 108. Portions 108 can include a structure to enhance clamping, such as a spike, a bump, a groove, and so forth. For example, such structure can be a conical projection extending from an inner surface of one of portions 108. Although portions 108 are rigid, portions 108 can be flexible. Also, although portions 108 are solid, portions 108 can be perforated. Moreover, although portions 108 are unitary, portions 108 can be assembled, such as via fastening, mating, locking, welding, gluing, magnetizing, interlocking, and so forth. Portions 108 can be identical to and/or different from each other in any measureable characteristic, such size, shape, weight, density, and so forth.

Portions 108 define a clamping space 116 therebetween. Space 116 is sized such that at least the bar, such as a tubular stroller frame portion, can fit therein. Although space 116 is partially enclosed via jaws 106, space 116 can also be substantially fully enclosed via jaws 106. Although space 116 is circular, space 116 can be shaped differently, such as ovoid, rectangular, square, triangular, and so forth.

Portions 110 are flat plate-shaped, but can be of other shapes configured for manual force application, such bowl-shaped. Although portions 110 are rigid, portions 110 can be flexible. Also, although portions 110 are solid, portions 110 can be perforated. Moreover, although portions 110 are unitary, portions 110 can be an assembled, such as via fastening, mating, locking, welding, gluing, magnetizing, interlocking, and so forth. Portions 110 can include a material to enhance tactile feedback, such as rubber. For example, such material can be a rectangular strap extending along an outer surface of one of portions 110. Portions 110 can include a structure to enhance tactile feedback, such as a spike, a bump, a groove, and so forth. For example, such structure can be a conical projection extending from an outer surface of one of portions 110. Portions 110 can be identical to and/or different from each other in any measureable characteristic, such size, shape, weight, density, and so forth.

Portions 108 move away from each other and enlarge space 116 in size when portions 110 move toward each other via manual force application onto portions 110 for fitting the bar, such as a tubular stroller frame portion, within space 116, such as for clamping onto the bar, such as a tubular stroller frame portion, and/or unclamping from the bar, such as a tubular stroller frame portion. Likewise, portions 108 move toward each other and reduce space 116 in size when portions 110 move away from each other as the manual force application ceases, such as for clamping onto the bar, such as a tubular stroller frame portion and/or unclamping from the bar, such as a tubular stroller frame portion. However, note that other clamping configurations can be used, whether additionally and/or alternatively. For example, such as when portions 110 control opposing portions 108.

Jaws 106 avoid rotating with respect to bridge 112, such as about a horizontal axis, such as bridge 112, such as via remaining stationary with respect to bridge 112 via pivot 114. However, jaws 106 can be configured to rotate with respect to bridge 112, such as with pivot 114, such as about a horizontal axis, such as bridge 112. Such rotation can be clockwise and/or counterclockwise. Such rotation can be for many ranges of rotation, such about 45 degrees, about 90 degrees, about 120 degrees, about 180 degrees, about 230 degrees, about 270 degrees, about 300 degrees, about 360 degrees, and so forth. Such rotation can be manual and/or automatic, such as battery-powered. For example, such rotation can occur when pivot 114 is operably coupled to an O-ring, which is also operably coupled to bridge 112, and/or a ball joint, which is also operably coupled to bridge 112. Such rotation can be free-rotation.

Although jaws 106 are spring-loaded for clamping, jaws 106 can clamp in other ways. For example, clamp 102 can include an elastic/tension member, such as an elastic band, a shape memory item, an elastic foam piece, and so forth. More than one of such member can be used. Such member facilitates clamping via jaws 106 based on elasticity/tension. Further for example, clamp 102 can clamp via biasing jaws 106 inwardly, toward each other. Such biasing is via a biasing force, which accommodates an outward movement of jaws 106 from a starting position and an inward movement of jaws 106 to the starting position when an anti-biasing force causing the outward movement is removed. The biasing force allows jaws 106 to clamp onto the stroller frame portion with spring-like tension. The biasing force is small enough to accommodate the outward movement (widening of a gap between clamping tips of jaws 106 and enlarging space 116) from the starting position, but strong enough to inwardly move jaws 106 back toward the starting position when the anti-biasing force causing the outward movement is removed. Additionally for example, note that clamp 102 can be structured such as a pipe clamp, an F-clamp, C-clamp, and so forth. Moreover for example, clamp 102 can operate as a clip. Resultantly, clamp 102 can clamp as a butterfly hairclip clamp, a clothespin clamp, a crocodile clamp, an automotive battery clamp, a construction clamp, and so forth.

Pivot 114 operably rests within bridge 112. Pivot 114 can include a pin, a shaft, a rod, an axle, an axis, and so forth. Pivot 114 is covered with a cap, but such cap can also be lacking. Jaws 106 are operably coupled to pivot 114, such as via fastening, mating, locking, magnetizing, and so forth. Therefore, jaws 106 are able to pivotally clamp about pivot 114 elastically, via the spring. Although pivot 114 is unitary, pivot 114 can be assembled, such as via fastening, mating, locking, welding, gluing, magnetizing, interlocking, and so forth. Although pivot 114 is solid, pivot 114 can be perforated.

Bridge 112 spans between pivot 114 and container 104 such that clamp 102 is operably coupled to container 104. Bridge 112 is rigid, but can be flexible as well. Bridge 112 can include a bar, a shaft, a beam, a frame, and so forth. Bridge 112 can include a lattice or a truss. Bridge 112 can be C-shaped, U-shaped, J-shaped, I-beam shaped, H-beam shaped, and so forth. Bridge 112 can be rectangular, square, trapezoidal, circular, elliptical, and so forth. Bridge 112 includes at least one level. Bridge 112 can include at least one truss and/or cable. Bridge 112 is assembled with pivot 114, such as via fastening, mating, locking, welding, gluing, magnetizing, interlocking, and so forth, but bridge 112 and pivot 114 can be unitary. Although bridge 112 is assembled with container 104, such as via fastening, mating, locking, welding, gluing, magnetizing, interlocking, and so forth, bridge 112 and container 104 can be unitary. Bridge 112 is solid, but bridge 112 can be perforated. Note that bridge 112 can extend along a horizontal axis, a vertical axis, or any combination thereof in any dimension, such as 3-dimensions.

Bridge 112 avoids rotating with respect to pivot 114 and to container 104, such as about a horizontal axis, such as via remaining stationary with respect to pivot 114 and to container 104. However, bridge 112 can be configured to rotate with respect to pivot 114 and to container 104, such as about a horizontal axis. Such rotation can be clockwise and/or counterclockwise. Such rotation can be for many ranges of rotation, such about 45 degrees, about 90 degrees, about 120 degrees, about 180 degrees, about 230 degrees, about 270 degrees, about 300 degrees, about 360 degrees, and so forth. Such rotation can be manual and/or automatic, such as battery-powered. Such rotation can occur when each end of bridge 112 is operably coupled to an O-ring and/or a ball joint where the O-ring and/or the ball joint are operably coupled to pivot 114 and container 104. Such rotation can be free-rotation Container 104 avoids rotating with respect to bridge 112, such as about a horizontal axis, such as bridge 112, such as via remaining stationary with respect to bridge 112. However, container 104 can be configured to rotate with respect to bridge 112. Such rotation can be clockwise and/or counterclockwise. Such rotation can be for many ranges of rotation, such about 45 degrees, about 90 degrees, about 120 degrees, about 180 degrees, about 230 degrees, about 270 degrees, about 300 degrees, about 360 degrees, and so forth. Such rotation can be manual and/or automatic, such as battery-powered. For example, such rotation can occur when container 104 is operably coupled to an O-ring, which is also operably coupled to bridge 112, and/or a ball joint, which is also operably coupled to bridge 112. Such rotation can be free-rotation Container 104 includes a lid 118, a finger groove 120, an aperture 122, a pivot 124, an upper compartment edge portion 126, an upper compartment 128, an upper spine 130, a lower compartment edge portion 132, a lower compartment 134, and a lower spine 136. Although container 104 is a right circular cylinder, container 104 can be differently shaped, such as another type of cylinder, a bowl, a cube, a cuboid, a sphere, an ovoid, and so forth.

Lid 118 at least partially controls access into compartment 128. Lid 118 is circular, but can have another shape, such as a parallelogram, a triangle, a quadrilateral, an ellipse, and so forth. Lid 118 can be flush with portion 126. Lid 118 can be non-flush with portion 126. Lid 118 can include a rubber strip to function as a gasket, such as to contain a content leak and/or a content odor emanating from within compartment 128. Lid 118 can include a magnet configured for attraction to portion 126. Such magnetic attraction enhances lid 118 resting on portion 126. Lid 118 can be freely pivoted, automatically pivoted, elastically pivoted, gear pivoted, and so forth. Lid 118 can be configured to elastically return to a default position, such as a closed position. Note that container 104 can lack lid 118 as well. Lid 118 can be opaque, transparent, and/or translucent. Lid 118 can include a material to enhance tactile feedback, such as a rectangular rubber strip disposed externally thereon. Lid 118 can include a structure to enhance tactile feedback, such as a spike, a bump, a groove, and so forth, which can include rubber. Such structure can be disposed externally thereon. Although lid 118 is solid, lid 118 can be perforated. In other embodiments, lid 118 can include a plurality of components, such as a set of doors, plates, and so forth. Further, lid 118 can include a trapdoor/hatch, which can slide sideways for opening and/or pivot inward for opening. Also, note that in some embodiments, lid 118 can avoid attachment to compartment 128 and instead have a handle coupled thereto. Therefore, lid 118 can be lifted from compartment 128 saucepot style. In such configuration, lid 118 can be magnetized for secure resting on compartment 128.

Lid 118 includes groove 120, which is configured to receive pivoting force applied via a user's finger. Groove 120 is sized for at least one of such fingers. Note that more than one groove 120 can be used, which can be different and/or identical to each other in any measureable characteristic, such as height, length, depth, volume, shape, and so forth. Further, note that lid 118 can lack groove 120 as well. Groove 120 can be opaque, transparent, and/or translucent. Groove 120 can include a material to enhance tactile feedback, such as a rectangular rubber strip disposed within groove 120. Groove 120 can include a structure to enhance tactile feedback, such as a spike, a bump, a groove, and so forth. For example, such structure can be a cone disposed within groove 120. Although groove 120 is solid, groove 120 can be perforated, such as to provide fluid communication access into compartment 128.

Lid 118 includes aperture 122, which is configured to partially contain pivot 124. Note that lid 118 can lack aperture 122. Aperture 122 is circular, but can be shaped differently, such as a parallelogram. Further, note that pivot 124 can be removed via aperture 122. Also, note that aperture 122 can be closed to enhance secure positioning of pivot 124 thereunder.

Pivot 124 is configured to allow for pivoting of lid 118 thereabout. Pivot 124 can be a pin, a shaft, a rod, an axle, an axis, and so forth. Pivot 124 extends from aperture 122 through spine 136. However, note that container 104 can include a plurality of pivots 124, which can be identical and/or different from each other in any measurable characteristic, such as length, width, volume, density, and so forth. Such pivots 124 extend along a same axis, but can be different axes as well, such as a vertical axis. Further, such pivots 124 can be in contact with each other and/or avoid contact with each other. For example, first pivot 124 can be for lid 118 and second pivot 124 can be for compartment 134 where the first pivot 124 and the second pivot 124 are not coplanar with each other. Although pivot 124 is solid, pivot 124 can be perforated.

Lid 118 rests on portion 126. Portion 126 is circular, but can have another shape, such as a parallelogram, a triangle, a quadrilateral, an ellipse, and so forth. Portion 126 can include a rubber strip to function as a gasket, such as to contain a content leak and/or a content odor emanating from within compartment 128. Portion 126 can include a magnet configured for attracting to lid 118. Such magnetic attraction enhances lid 118 resting on portion 126.

Compartment 128 is configured for internal containment of trash. Such containment can be direct where the trash directly contacts compartment 128, such as when compartment 128 lacks a trash bag operatively installed therein. Further, whether additionally and/or alternatively, such containment can be indirect where compartment 128 contains a trash bag, such as a single use plastic trash bag, operatively installed for directly containing the trash within the bag. Although compartment 128 is a right circular cylinder, compartment 128 can be differently shaped, such as non-circular cylinder, a cube, a cuboid, a prism, a cone, a pyramid, and so forth. Although a sidewall or a base of compartment 128 is solid, a perforated or a slotted configuration is possible. For example, the sidewall of compartment 128 can be defined via a set of horizontally or vertically extended boards defining a set of horizontal or vertical open slots therebetween and therethrough. Similarly, the base of compartment 128 can include a set of concentric boards defining a set of concentric open slots therebetween and therethrough. Alternatively, the base of compartment 128 can be X-shaped, I-shaped, H-shaped, or V-shaped, as extending between the sidewall of compartment 128.

Spine 130 bulges/projects outwardly from compartment 128. Note though that spine 130 can be flush with compartment 128. Further, note that spine 130 can cave/project inwardly into compartment 128. Spine 130 is U-shaped, but can be differently shaped as well, such as a C-shape, a V-shape, and so forth. Spine 130 contains pivot 124. Although spine 130 is solid, spine 130 can be perforated.

Compartment 128 has a height extending along spine 130. Lid 118 is configured for pivoting about an axis extending along such height. Such pivoting is via pivot 124 with respect to compartment 128. Further, compartment 128 includes an opaque sidewall. However, note that the sidewall can be transparent and/or translucent.

Compartment 128 is positioned above portion 132. Compartment 128 is in contact with portion 132, but can avoid such contact as well. Portion 132 is circular, but can have another shape, such as a parallelogram, a triangle, a quadrilateral, an ellipse, and so forth. Portion 132 can include a rubber strip to function as a gasket, such as to contain a content leak and/or a content odor emanating from within compartment 134. Portion 132 can include a magnet configured for attracting to a bottom surface of compartment 128. Such magnetic attraction enhances compartment 128 securing to portion 132. Note that portion 126 and portion 132 can be identical to and/or different from each other in any measurable characteristic, such as length.

Compartment 134 can be configured for internal containment of trash. Such containment can be direct where the trash directly contacts compartment 134, such as when compartment 134 lacks a trash bag operatively installed therein. Further, whether additionally and/or alternatively, such containment can be indirect where compartment 134 contains a trash bag, such as a single use plastic trash bag, operatively installed for directly containing the trash within the bag. Also, note that compartment 134 can be configured for storing non-trash content, such as a case storing a plurality of single use trash bags operably coupled to each other. Although compartment 134 is a right circular cylinder, compartment 134 can be differently shaped, such as non-circular cylinder, a cube, a cuboid, a prism, a cone, a pyramid, and so forth. Although a sidewall or a base of compartment 134 is solid, a perforated or a slotted configuration is possible. For example, the sidewall of compartment 134 can be defined via a set of horizontally or vertically extended boards defining a set of horizontal or vertical open slots therebetween and therethrough. Similarly, the base of compartment 134 can include a set of concentric boards defining a set of concentric open slots therebetween and therethrough. Alternatively, the base of compartment 134 can be X-shaped, I-shaped, H-shaped, or V-shaped, as extending between the sidewall of compartment 134.

Further, compartment 134 includes an opaque sidewall. However, note that the sidewall can be transparent and/or translucent. Note that in some embodiments, container 104 lacks compartment 134. Further, note that in some embodiments, compartment 134 is configured for pivoting downward away from compartment 128 and lid 118. Such pivoting can be hinged. Compartment 134 is selectively lockable to compartment 128 to avoid undesired pivoting. In some embodiments, bridge 112 can extending between clamp 102 and compartment 134.

Spine 136 bulges/projects outwardly from compartment 134. Note though that spine 136 can be flush with compartment 134. Further, note that spine 136 can cave/project inwardly into compartment 134. Spine 136 is U-shaped, but can be differently shaped as well, such as a C-shape, a V-shape, and so forth. Spine 136 contains pivot 124. Although spine 136 is solid, spine 136 can be perforated. Spine 130 and spine 136 can be identical to and/or different from each other in any measurable characteristic, such as orientation, length, and so forth.

Compartment 134 has a height extending along spine 136. Compartment 134 is configured for pivoting about an axis extending along such height. Such pivoting is via pivot 124 and with respect to compartment 128. Lid 118 and compartment 134 can pivot with respect to compartment 128 in different and/or identical directions, such as clockwise or counterclockwise. In other embodiments, compartment 134 pivots about a horizontal axis extending along a base of compartment 128. In other embodiments, compartment 134 is pivotally coupled to compartment 128 via an H-shaped member, with an upper portion of the H-shaped member coupled or stationed within compartment 128 and a lower portion of the H-shaped member coupled or stationed within compartment 134.

Container 100 can be used with many types of transport devices, such as strollers, such as for a single child, for a plurality of children, a side-by-side seating configuration, a stadium-seating configuration, a snap-and-go chassis carriage, a canopied stroller, a wheeled baby carriage, an open stroller, a travel system, and so forth. Other transport devices include car seat wheeled carriers, children's tricycles, or other forms of baby or child wheeled transport. Still other forms of transport devices include wheelchairs, hand trucks, golf carts, walking frames, or shopping carts. Yet still other forms of transport devices include bikes, scooters, or motorcycles. For example, container 100 can be used with many types of frame portions, such as a unitary frame, an assembled frame, a stroller frame member, a sleeve extending over a stroller frame portion, and so forth. Such frame portions can include metal, plastic, wood, rubber, and so forth. Such frame portions can be hollow, solid, rigid, flexible, and so forth. Further, note that container 100 can also be used with a wheel chair, an infant car seat, a toddler car seat, a detachable baby seat, a bed, a crib, a high chair, and so forth.

Note that container 100 is sufficiently lightweight so as not to cause a transport device, such as a stroller, with which container 100 is used, to tip over at least when container 104 is empty. For example, when container 100 is used with a rubberized hand placement stroller frame portion, container 100 is sufficiently lightweight so as not to cause the stroller to tip over.

In an example mode of operation, the user places the user's fingers onto portions 110. The user applies manual pressure onto portions 110. Portions 110 move toward each other. Portions 108 move away from each other and enlarge space 116 thereby. The stroller frame portion is positioned into space 116. The user ceases to apply manual pressure onto portions 110 and portions 110 move away from each other. Portions 108 move toward each other and reduce space 116 until portions 108 clamp onto the stroller frame portion. The user rotates container 104 against clamp 102, for instance via bridge 112, such that container 104 is in a comfortable position for the user, such as upright perpendicular to a ground surface, parallel to the ground surface, inclined with respect to the ground surface, and so forth. The user places the user's finger onto groove 120 and slides lid 118 sideways to place trash into compartment 128. The user slides lid 118 back via groove 120 such that the trash is contained within compartment 128. The lid rests on portion 126 via magnetic attraction. The user slides compartment 134 open if desired.

Figure 2:
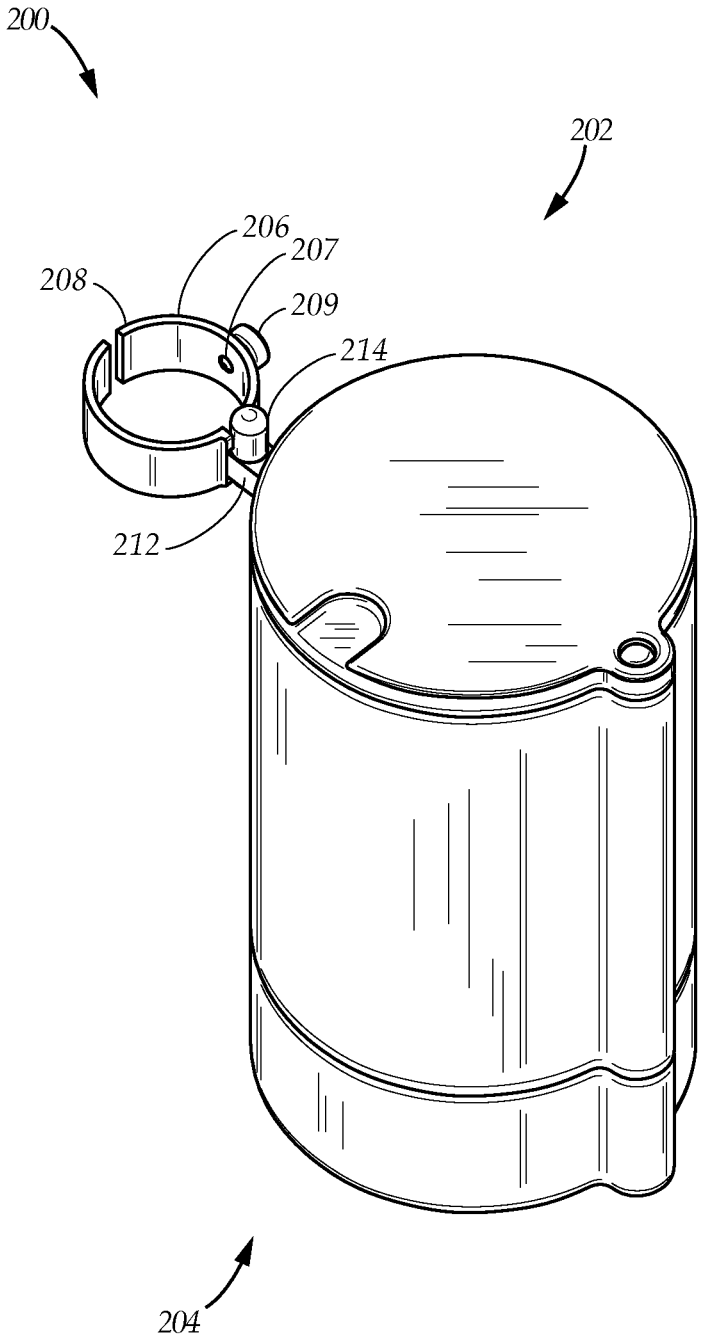
FIG. 2 shows a perspective view of another example embodiment of a clamp-equipped trash container according to the present disclosure.

FIG. 2 shows a perspective view of another example embodiment of a clamp-equipped trash container according to the present disclosure. Some elements of this figure are described above. Thus, same/similar reference characters identify same/similar components described above and any repetitive detailed description thereof will hereinafter be omitted or simplified in order to avoid complication.

A stroller accessory 200 includes a clamp 202, a trash container 204, and a bridge 212 spanning therebetween. Clamp 202 includes a pivot 214, a pair of jaws 206, and a spring. Pivot 214 has a cap thereon. One of jaws 206 is operably coupled to pivot 214 and the other of jaws 206 is coupled to bridge 212. However, note that in other embodiments, both jaws 206 are operably coupled to pivot 214. The spring tensions the one of jaws 206 for clamping onto the bar, such as a tubular stroller frame portion. Such tensioning is against bridge 212, but can also be against the other of jaws 206. The spring is a helical/coil spring, but can be a flat spring, and so forth. Bridge 212 spans from pivot 214 to container 204. Clamp 202, bridge 212, and/or container 204 can include metal, plastic, wood, rubber, and so forth.

Jaws 206 include a pair of clamping portions 208. One of jaws 206 is elastically pivoting, while the other one of jaws 206 is stationary. However, note that both of jaws 206 can be elastically pivoting against bridge 212 and/or against each other. One of jaws 206 that elastically pivots includes a circular aperture 207. A fastener 209, such as a bolt, a screw, and so forth, extends through aperture 207. Fastener 209 can include metal, wood, plastic, rubber, and so forth. Fastener 209 is configured for fastening against the bar, such as a tubular stroller frame portion, through aperture 207, such as a set screw, such as for more secure clamping. Note that both jaws 206 can include apertures 207 and fasteners 209. Also, note that the one of jaws 206 that pivots can be biased via a biasing force, as described herein. Further, note that both of jaws 206 can be biased via a biasing force, as described herein.

In an example mode of operation, the user pivots one of jaws 206 such that the stroller frame portion is positioned for clamping by jaws 206. Portions 208 move toward each other until portions 208 clamp onto the stroller frame portion. If such clamping is insufficiently tight, then the user can fasten fastener 209 through aperture 207 to tighten clamping of the one of jaws 206 against the stroller frame portion. The user rotates container 204 against clamp 202, for instance via bridge 212, such that container 204 is in a comfortable position for the user, such as upright.

Figure 3:
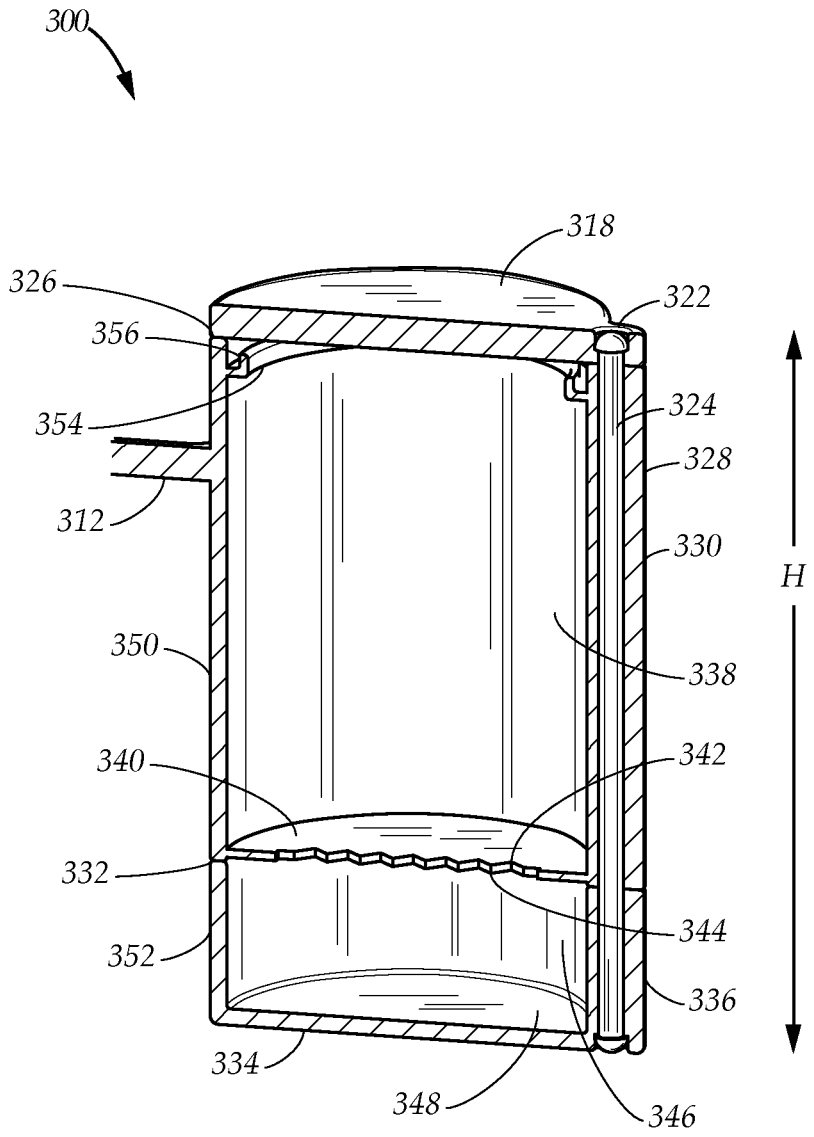
FIG. 3 shows a cross-sectional view of an example embodiment of a trash container with a plurality of compartments according to the present disclosure.

FIG. 3 shows a cross-sectional view of an example embodiment of a trash container with a plurality of compartments according to the present disclosure. Some elements of this figure are described above. Thus, same reference characters identify identical and/or like components described above and any repetitive detailed description thereof will hereinafter be omitted or simplified in order to avoid complication.

A clamp-equipped trash container 300 includes a clamp, a trash container, and a bridge 312 spanning therebetween. An upper compartment 328 includes an upper compartment edge portion 326. A lid 318 rests on portion 326. An aperture 322 partially contains a pivot 324. An upper spine 330 protrudes from compartment 328. A lower compartment 334 includes a lower compartment edge portion 332. Compartment 328 rests on portion 332. A lower spine 336 protrudes from compartment 334.

Compartment 328 includes an interior chamber 338 defined via a base 340 and a sidewall 350 extending upwardly from base 340 toward lid 318. Base 340 is circular, but can be shaped differently, such as ovoid, rectangular, square, and so forth. Chamber 338 is sized to contain trash, such as a used wet wipe, a used tissue, and so forth. Such containment can be direct where the trash directly contacts at least one of base 340 and sidewall 350, such as when chamber 338 lacks a trash bag operatively installed therein. Further, whether additionally and/or alternatively, such containment can be indirect where chamber 338 contains a trash bag, such as a single use plastic trash bag, operatively installed along sidewall 350 for directly containing the trash within the bag. For example, the trash bag can be mounted over portion 326, while substantially positioned within chamber 338. Although chamber 338 is a right circular cylinder, chamber 338 can be differently shaped, such as non-circular cylinder, a cube, a cuboid, a prism, a cone, a pyramid, and so forth. Note that base 340 and/or sidewall 350 can be coated with an antibacterial coating and/or an anti-mildew coating.

Base 340 includes a slot 342. Slot 342 includes a plurality of teeth 344, which make slot 342 serrated. Teeth 344 can be sharp and/or dull. Teeth 344 can be identical and/or different from each other in any measurable characteristic, such as shape, size, and so forth. Teeth 344 can be sharp and/or curved. Teeth 344 can be on one side of slot 342 and/or on both sides of slot 342. Slot 342 provides access to chamber 338. Note that in some embodiments, slot 342 is lacking. Further, note that in some embodiments, slot 342 lacks teeth 344 and/or is non-serrated.

Compartment 334 includes an interior chamber 346 defined via a base 348 and a sidewall 352 extending upwardly from base 348 toward compartment 328. Base 348 is circular, but can be shaped differently, such as ovoid, rectangular, square, and so forth. Base 348 and base 340 can be identical to each other and/or different from each other in any measurable characteristic, such as shape, size, area, and so forth. Sidewall 350 and sidewall 352 can be identical to each other and/or different from each other in any measurable characteristic, such as shape, size, area, and so forth. Chamber 346 is sized to contain trash, such as a used wet wipe, a used tissue, and so forth. Such containment can be direct where the trash directly contacts at least one of base 348 and sidewall 352, such as when chamber 346 lacks a trash bag operatively installed therein. Further, whether additionally and/or alternatively, such containment can be indirect where chamber 346 contains a trash bag, such as a single use plastic trash bag, operatively installed along sidewall 352 for directly containing the trash within the bag. Although chamber 346 is a right circular cylinder, chamber 346 can be differently shaped, such as non-circular cylinder, a cube, a cuboid, a prism, a cone, a pyramid, and so forth. Note that base 348 and/or sidewall 352 can be coated with an antibacterial coating and/or an anti-mildew coating. Chamber 338 and chamber 346 can be different from each other and/or identical to each other. Chamber 338 and chamber 346 are in fluid communication via slot 342.

Compartment 328 includes an L-shaped ledge portion defined via a base portion 354 and a tower portion 356. The ledge portion functions for leak/odor sealing purposes, such as the gasket described herein, and/or for as trash bag securing purposes, as described herein. For example, the trash bag can be mounted onto the L-shaped ledge portion. Note that compartment 328 can include other structures for trash bag securing, such as J-hooks, and so forth. Note that in some embodiments, the L-shaped ledge portion is lacking.

Figure 4:
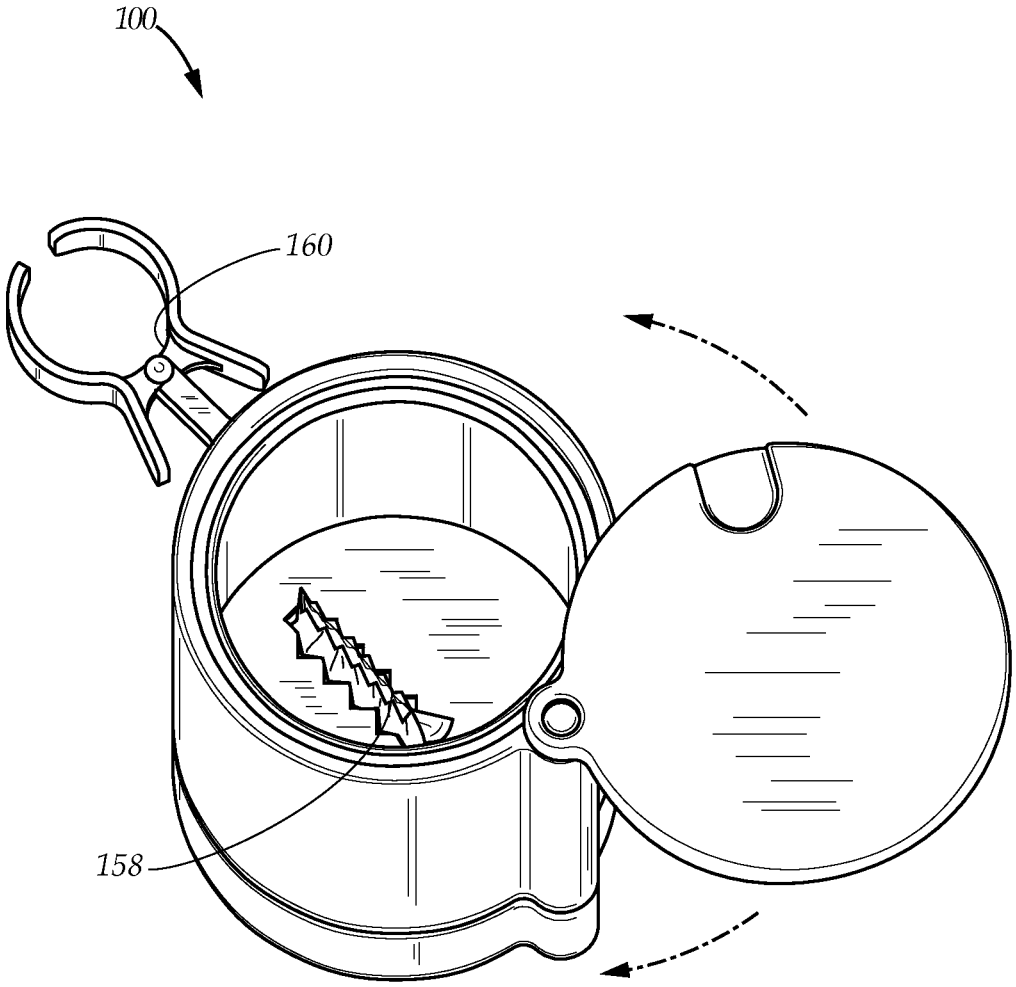
FIG. 4 shows a perspective view of an example embodiment of a single use trash bag extending through a serrated slot of a trash container according to the present disclosure.

FIG. 4 shows a perspective view of an example embodiment of a single use trash bag extending through a serrated slot of a trash container according to the present disclosure. Some elements of this figure are described above. Thus, same/similar reference characters identify same/similar components described above and any repetitive detailed description thereof will hereinafter be omitted or simplified in order to avoid complication.

A trash bag 158 extends from compartment 134 into compartment 128 via serrated slot 342, as described herein. Note that if bag 158 is coupled to another trash bag, then the serrated slot is capable of decoupling, such as via separating, bag 158 from the other bag, such as via cutting, puncturing, and so forth, based on manual adjustable pulling of bag 158, such as against slot 342. Bag 158 includes plastic, cloth, and so forth. Bag 158 can be unperforated from another bag and/or perforated with another bag.

A pair of coupling portions 160 operably couples jaws 106 to pivot 114 via portions 110. Portions 160 can be identical to and/or different from each other in any measurable characteristic, such as length, volume, and so forth. Portions 160 are unitary with portions 110, but can be assembled to portions 110, such as via fastening, mating, locking, welding, gluing, magnetizing, interlocking, and so forth. Portions 160 can include metal, plastic, wood, rubber, and so forth. Portions 160 are rigid, but can be flexible. Portions 160 can include frame members. Portions 160 can include the spring and/or the elastic/tension member.

Lid 118 is pivoted on pivot 124 about the axis extending along the height of compartment 128. Such pivoting is for providing access to chamber 138 and for restricting access to chamber 138. Such rotation can be full, such as about 360 degrees. Such rotation can be partial, such as less than about 360 degrees. Such rotation can be clockwise. Such rotation can be counterclockwise.

Figure 5A:
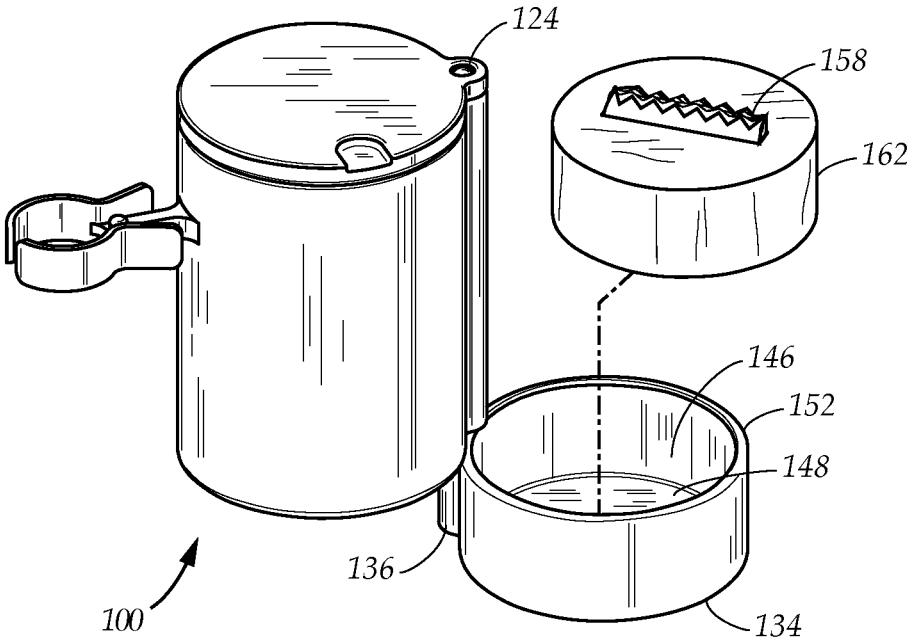
FIG. 5A shows a perspective view of an example embodiment of a case of a plurality of single use trash bags ready for placement into a pivotally open lower compartment of a trash container according to the present disclosure.

FIG. 5A shows a perspective view of an example embodiment of a case of a plurality of single use trash bags ready for placement into a pivotally open lower compartment of a trash container according to the present disclosure. Some elements of this figure are described above. Thus, same/similar reference characters identify same/similar components described above and any repetitive detailed description thereof will hereinafter be omitted or simplified in order to avoid complication.

Compartment 134 is pivoted via pivot 124 about the axis extending along the height of compartment 128 such that compartment 128 is not overlapping compartment 134. Pivot 124 extends into spine 136, which pivots along with compartment 134. Compartment 134 includes an interior chamber 146 defined via a base 148 and a sidewall 152 extending upwardly from base 148 toward lid 118.

A case 162 stores a plurality of trash bags 158, which can be single use trash bags. Chamber 146 is sized to snugly contain case 162 therein, although non-snug containment is possible as well. Case 162 is a right circular cylinder, but case 162 can be differently shaped, such as another type of cylinder, a bowl, a cube, a cuboid, a sphere, an ovoid, and so forth. Case 162 includes a slot through which bags 158 are retrievable. Such slot can include a plurality of teeth and/or be serrated for decoupling bags 158 from each other, as described herein. However, note that such slot can also lack the teeth and/or be non-serrated. Also, note that although such slot is location on a top side of case 162, such slot can also be located on other sides of case 162, such as a sidewall of case 162.

Figure 5B:
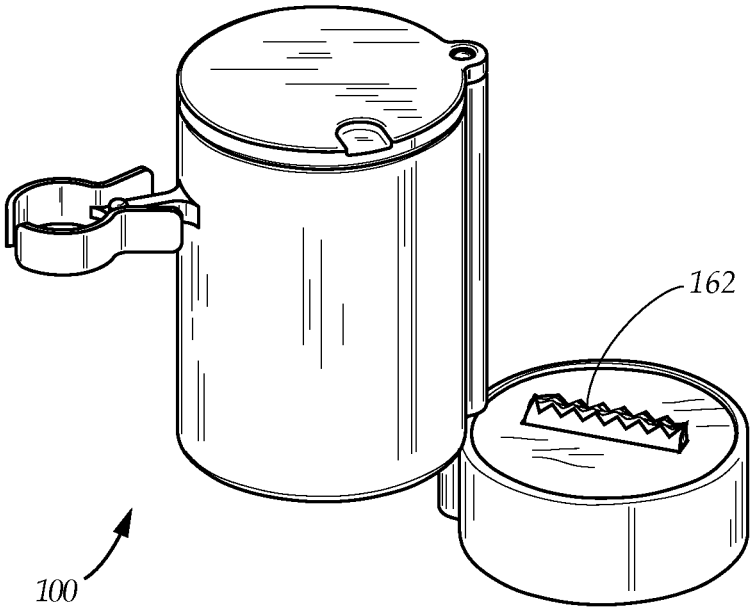
FIG. 5B shows a perspective view of an example embodiment of a pivotally open lower compartment containing a case of a plurality of single use trash bags according to the present disclosure.

FIG. 5B shows a perspective view of an example embodiment of a pivotally open lower compartment containing a case of a plurality of single use trash bags according to the present disclosure. Some elements of this figure are described above. Thus, same/similar reference characters identify same/similar components described above and any repetitive detailed description thereof will hereinafter be omitted or simplified in order to avoid complication.

Case 162 is placed into chamber 146 for snug containment therein.

Figure 5C:
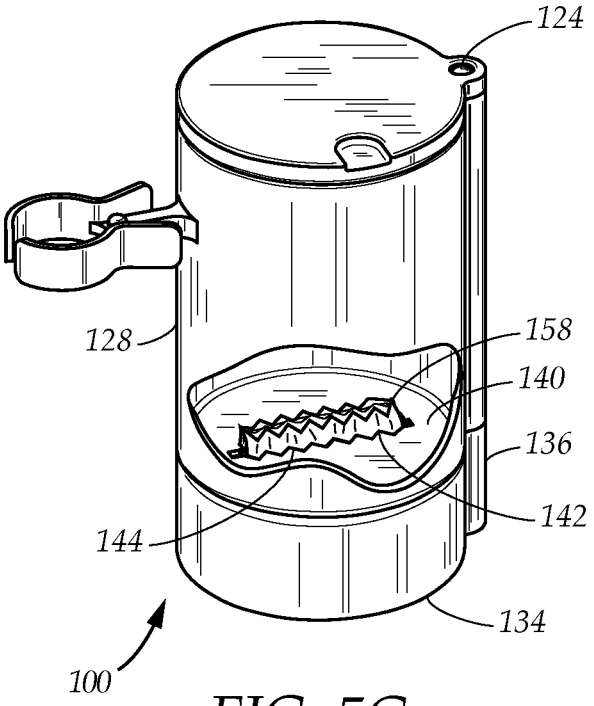
FIG. 5C shows a perspective view of an example embodiment of a single use trash bag extending through a serrated slot from a case of a plurality of single use trash bags contained in a pivotally closed lower compartment of a trash container according to the present disclosure.

FIG. 5C shows a perspective view of an example embodiment of a single use trash bag extending through a serrated slot from a case of a plurality of single use trash bags contained in a pivotally closed lower compartment of a trash container according to the present disclosure. Some elements of this figure are described above. Thus, same/similar reference characters identify same/similar components described above and any repetitive detailed description thereof will hereinafter be omitted or simplified in order to avoid complication.

Compartment 134 is pivoted via pivot 124 about the axis extending along the height of compartment 128 such that compartment 128 is overlapping compartment 134. Such overlapping can be flush and/or non-flush, direct contact and/or indirect contact, partial and/or full. Spine 136 is pivoted to be flush with spine 130. Chamber 138 and chamber 146 are in fluid communication via slot 142 on base 140. Bags 158 extend from case 162, which is contained in chamber 146, through slot 142 into chamber 138. Teeth 144 are configured to decouple one of bags 158 from other bags 158, such as via cutting, severing, serrating, and so forth.

Figure 5D:
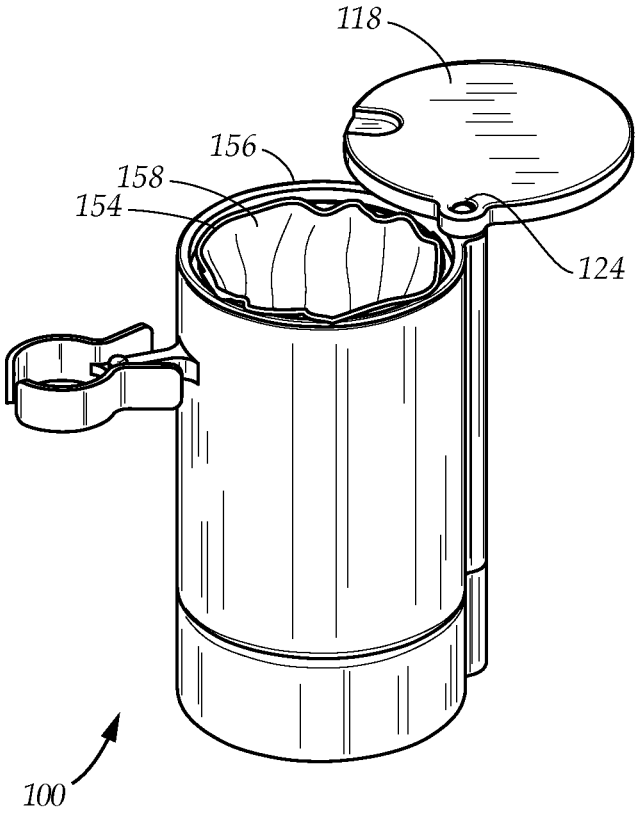
FIG. 5D shows a perspective view of an example embodiment of a single use trash bag installed in an upper compartment of a trash container according to the present disclosure.

FIG. 5D shows a perspective view of an example embodiment of a single use trash bag installed in an upper compartment of a trash container according to the present disclosure. Some elements of this figure are described above. Thus, same/similar reference characters identify same/similar components described above and any repetitive detailed description thereof will hereinafter be omitted or simplified in order to avoid complication.

Lid 118 is pivoted open on pivot 124 about the axis extending along the height of compartment 128. Compartment 128 includes an L-shaped ledge portion defined via a base portion 154 and a tower portion 156. One of bags 158 is pulled from slot 142 and mounted over portion 156 onto portion 154 for trash containment. Note that portion 156 and/or portion 154 can include a structure configured to enhancing such mounting, such as a hook-and-loop fastener, a J-hook, a magnet, an aperture for trash bag tucking, a spike, a clip, and so forth. The one of bags 158 can extend over portion 126, outside of chamber 138. Note that portion 126 can also include a structure configured to enhancing such mounting, such as a hook-and-loop fastener, a hook, a magnet, an aperture for trash bag tucking, a spike, a clip, and so forth, which can be externally disposed on compartment 128 or portion 126. Also, note that compartment 128 can include a structure, below portion 126 and external to chamber 138, configured to enhancing such mounting, such as a hook-and-loop fastener, a hook, a magnet, an aperture for trash bag tucking, a spike, a clip, and so forth.

Whenever desired, such as when the one of bags 158 is reasonably full of trash, the user can pull out the one of bags 158 from chamber 138 for disposal. The one of bags 158 is decoupled from other bags 158, such as via slot 142. A next one of bags 158 is pulled toward lid 118 and then mounted for trash containment within chamber 138. Note that such mounting can be manual and/or automatic, such as via a battery-powered trash bag mounting system. Also, note that the user can know when the one of bags 158 is reasonably full by pivoting lid 118 open. However, other ways of obtaining such knowledge are possible, such as sidewall 150 being transparent, lid 118 being transparent, the one of bags 158 is transparent, and so forth.

Figure 6:
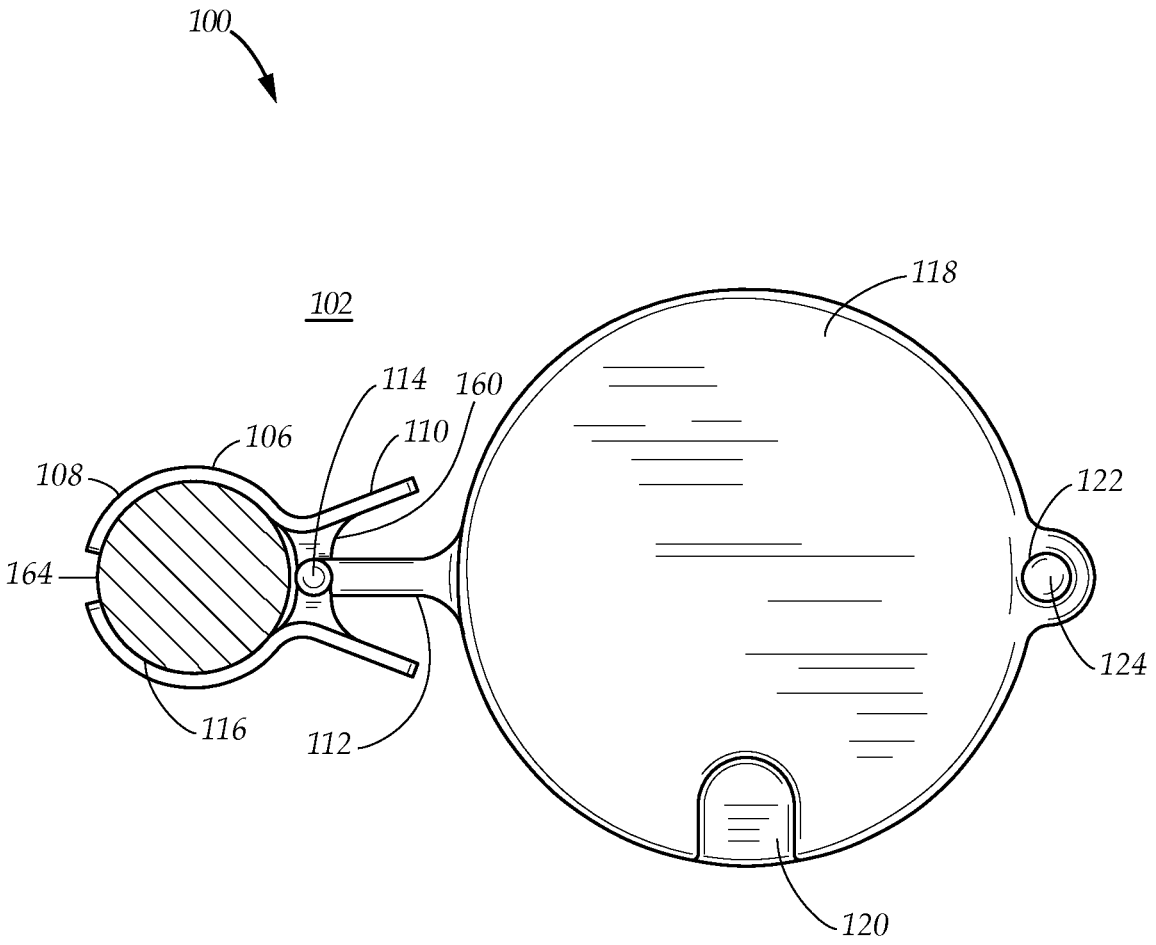
FIG. 6 shows a top view of an example embodiment of a clamp-equipped trash container clamping a cylindrical bar according to the present disclosure.

FIG. 6 shows a top view of an example embodiment of a clamp-equipped trash container clamping a cylindrical bar according to the present disclosure. Some elements of this figure are described above. Thus, same/similar reference characters identify same/similar components described above and any repetitive detailed description thereof will hereinafter be omitted or simplified in order to avoid complication.

A tubular portion 164 extends through space 116. Portion 164 is circular, but can have another shape, such as an ellipse, a parallelogram, a triangle, and so forth. Note that portion 164 and space 116 are both circular, but can be shaped differently from each other as well, such as when portion 164 is rectangular and space 116 is oval, portion 164 is square and space 116 is rectangular, and so forth. Portion 164 is hollow, but can be solid. Portion 164 can be perforated and/or non-perforated.

Jaws 106 clamp onto portion 164 via portions 108. Portions 108 have a pair of end tips. Note that such clamping is partial and such end tips avoid contacting each other. However, such clamping can also be full where such end tips contact each other.

In an example mode of operation, the user applies inward pressure toward bridge 112 onto portions 110. Such pressure moves portions 108 away from each other via jaws 106 pivoting about pivot 114 such that portion 164 can be fit into space 116. Once fit, the user relieves pressure from portions 110, which moves portions 108 back toward each other such that portion 164 is clamped via portions 108 and portions move away from each other in a direction away from bridge 112. The user can then pivot lid 118 open based on pivot 124 via groove 120. Note that in some embodiments, at least one of clamp 102 and/or container 104 can rotate with respect to each other.

Figure 7:
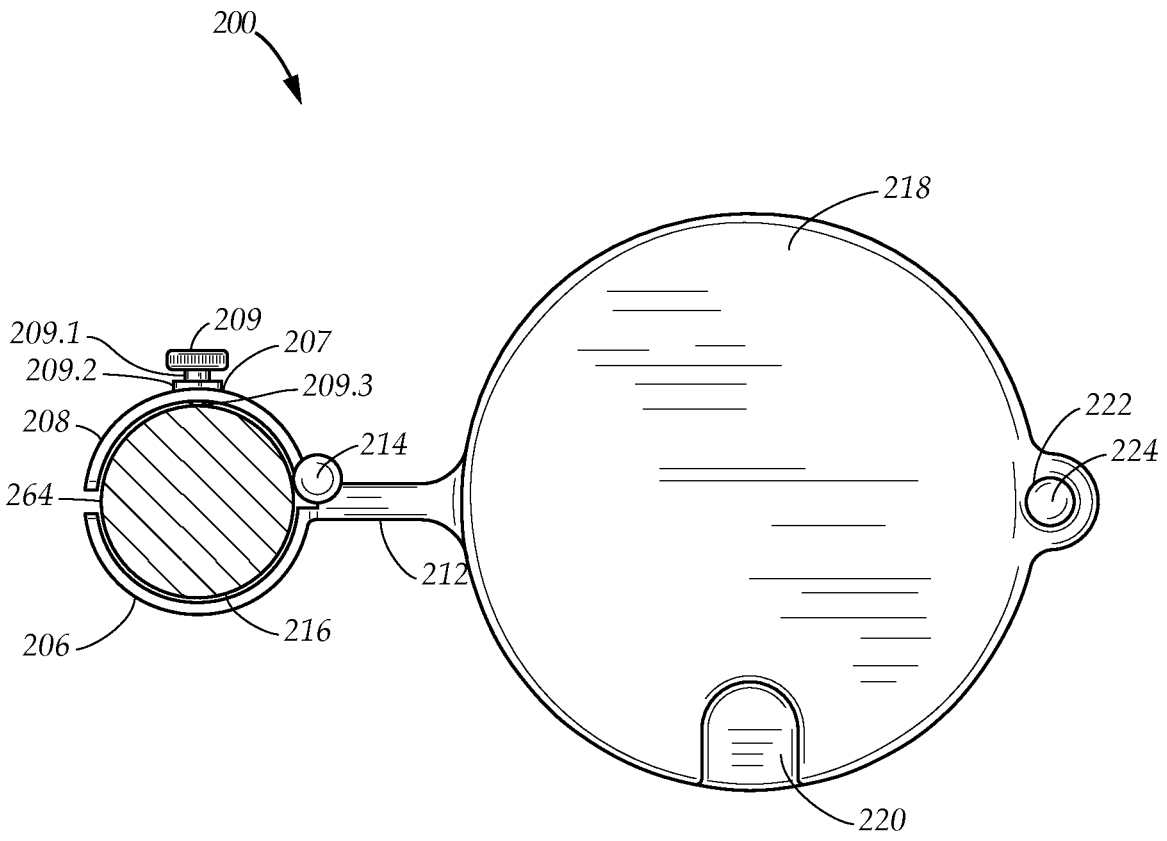
FIG. 7 shows a top view of an example embodiment of a fastener extending through a clamping jaw of a clamp and fastening against a cylindrical bar through the jaw according to the present disclosure.

FIG. 7 shows a top view of an example embodiment of a fastener extending through a clamping jaw of a clamp and fastening against a cylindrical bar through the jaw according to the present disclosure. Some elements of this figure are described above. Thus, same/similar reference characters identify same/similar components described above and any repetitive detailed description thereof will hereinafter be omitted or simplified in order to avoid complication.

A tubular portion 264 is within a space 216 enclosed by jaws 206. Such enclosure is partial, but can be full as well. Jaws 206 clamp onto portion 264 via portions 208. One of portions 208 has fastener 209 extending through aperture 207. Fastener 209 has a threaded portion 209.1, a washer 209.2, and a tip 209.3. Portion 209.1 threads within aperture 207. Whether additionally and/or alternatively, portion 209.1 threads within washer 209.2, which can be attached to the one of portions 208. Washer 209.2 distributes fastening load of fastener 209. Washer 209.2 can also be used a spacer, a spring, a wear pad, a preload indicating device, a locking device, and a vibration reducer, and so forth. Washer 209.2 can include metal, rubber, wood, plastic, and so forth. Tip 209.3 contacts portion 264.

The one of portions 208 is operably coupled to pivot 214. The one of portions 208 elastically pivots about pivot 214. Such pivoting can also be against the biasing force, as disclosed herein. Note that pivot 214 can adjust an elasticity level of such pivoting via turning of the cap of pivot 214. The other of portions 208 is operably coupled to bridge 212 and is stationary, but in some embodiments, is operably coupled to pivot 214 to pivot about pivot 214 as well.

In an example mode of operation, the user moves, such as via pulling, the one of portions 208, which is operably coupled to pivot 214, away from the other of portions 208, which is operably coupled to bridge 212. Such movement enlarges space 216 and allows for portion 264 to fit within space 216. The user lets go of the one of portions 208, which then automatically moves back via elastic pivoting about pivot 214. Such movement reduces space 216 and enables jaws 206 to enclose space 216 for clamping onto portion 264. If such clamping is insufficiently tight, then the user tightens fastener 209 through aperture 207 to increase clamping pressure via portions 208.

Figure 8:
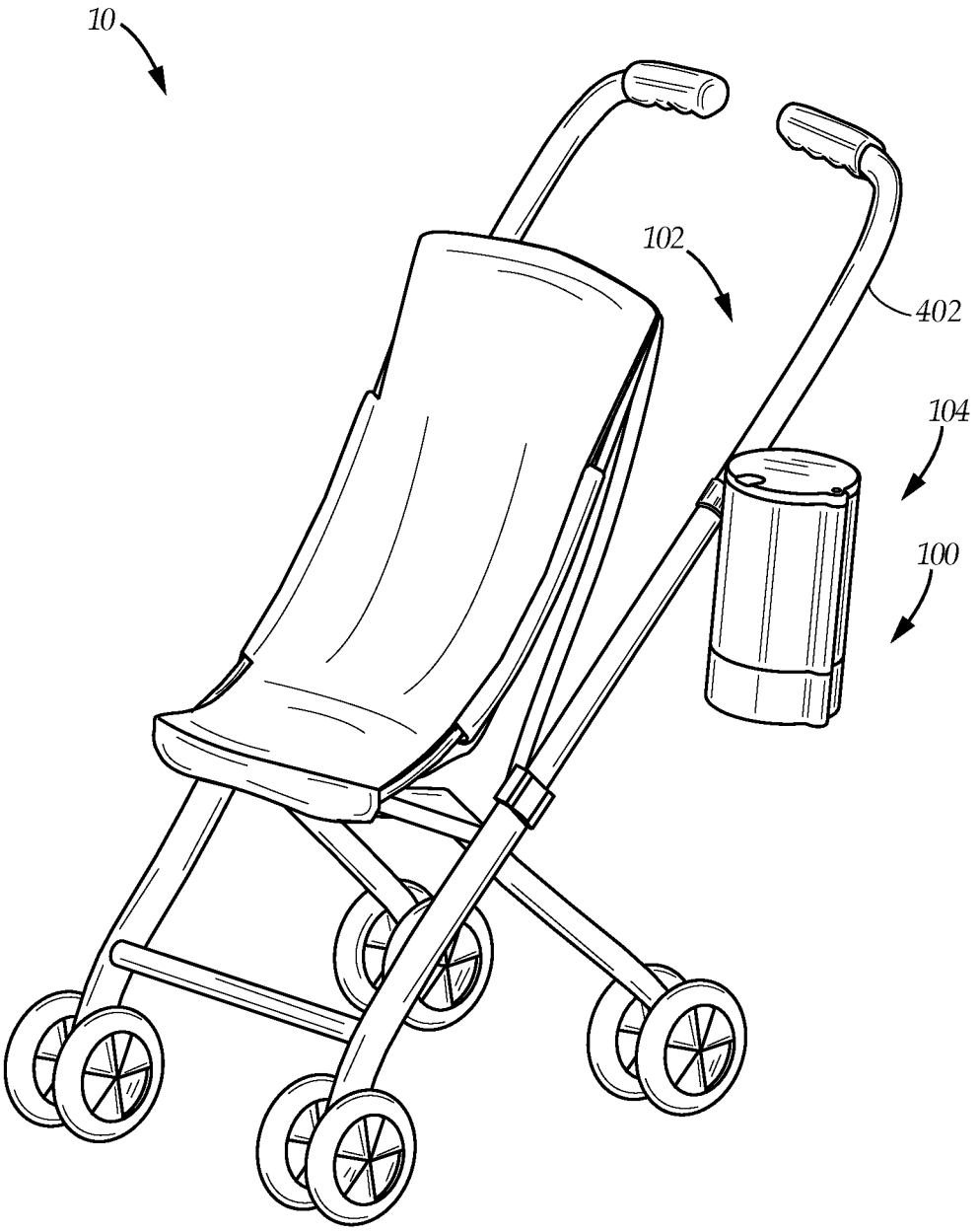
FIG. 8 shows a perspective view of an example embodiment of a clamp-equipped trash container in use with a stroller according to the present disclosure.

FIG. 8 shows a perspective view of an example embodiment of a clamp-equipped trash container in use with a stroller according to the present disclosure. Some elements of this figure are described above. Thus, same/similar reference characters identify same/similar components described above and any repetitive detailed description thereof will hereinafter be omitted or simplified in order to avoid complication.

A stroller 400 includes a stroller frame portion 402, where clamp 102 clamps onto portion 402. Container 104 is substantially upright and ready for trash containment, whether direct and/or indirect. Note that clamp 102 can be clamped to stroller 400 in other portions as well, such as a handle portion. Also, note that clamp 102 can be used for clamping into other devices or portions thereof.

Figure 9:
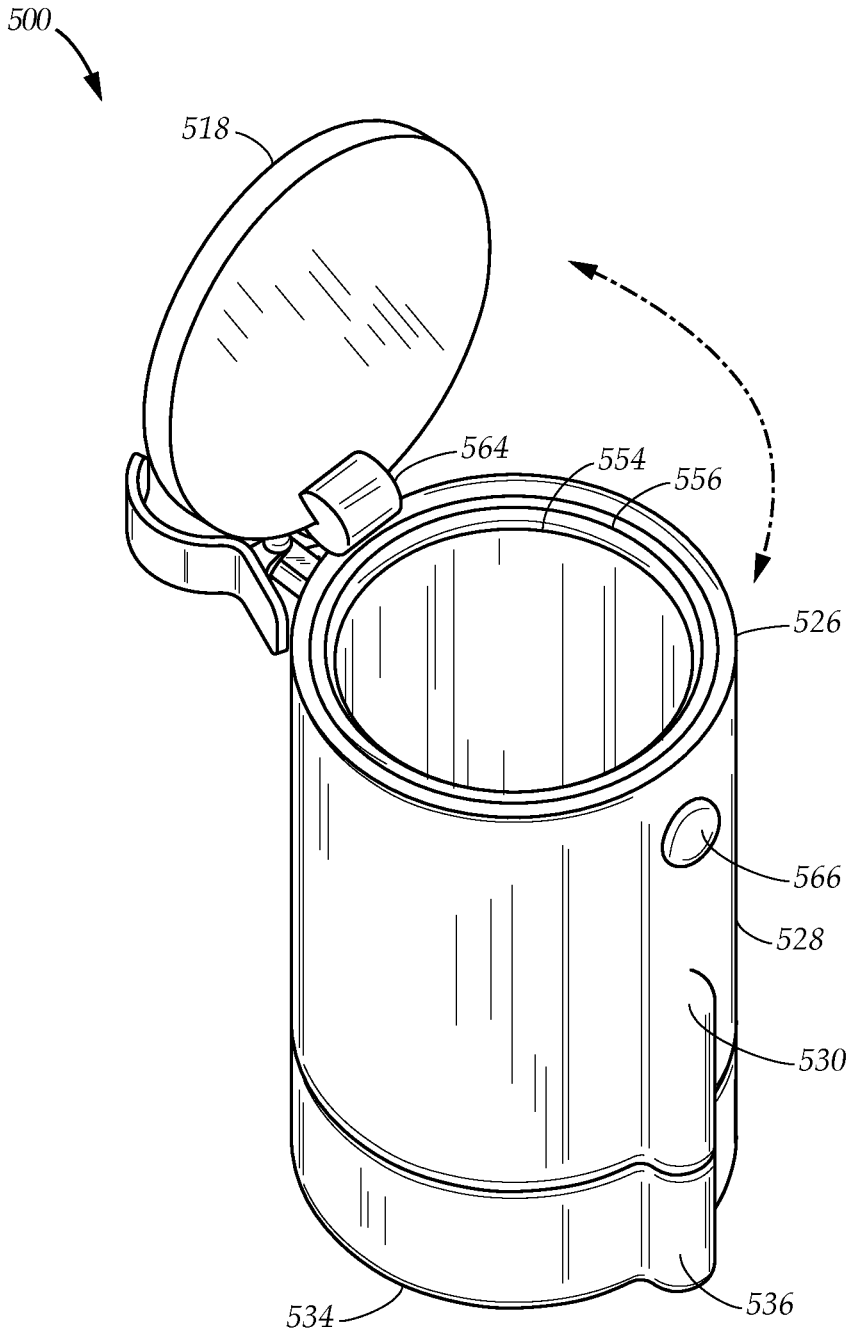
FIG. 9 shows a perspective view of an example embodiment of a trash container lid as pivotally opened toward a clamp according to the present disclosure.

FIG. 9 shows a perspective view of an example embodiment of a trash container lid as pivotally opened toward a clamp according to the present disclosure. Some elements of this figure are described above. Thus, same/similar reference characters identify same/similar components described above and any repetitive detailed description thereof will hereinafter be omitted or simplified in order to avoid complication.

A clamp-equipped trash container 500 includes a clamp, a trash container, and a bridge spanning therebetween. The container includes an upper compartment 528 and a lower compartment 534 disposed underneath compartment 528. A lid 518 at least partially controls access to compartment 528. The container includes an L-shaped ledge portion defined via a base portion 554 and a tower portion 556. Lid 518 rests on base portion 554 along portion 556. The container includes an edge portion 526. Compartment 528 includes a spine 530. Compartment 534 includes a spine 536 below spine 530.

The container includes a hinge 564. Hinge 564 can include metal, wood, plastic, rubber, and so forth. Hinge 564 can be a barrel hinge, a pivot hinge, and so forth. Hinge 564 enables lid 518 to pivot perpendicularly to the axis extending along the height of compartment 528. However, note that such pivoting can also be performed without hinge 564 as well, such as when lid 518 include a pair of side horns pivotally coupled to compartment 528.

Hinge 564 is positioned adjacent to the bridge and/or the clamp for enabling lid 518 to pivot toward the bridge and/or the clamp. However, note that such positioning can be different, such as hinge 564 being perpendicular to the bridge, diametrically opposed to the bridge, and so forth. Therefore, lid 518 can pivot in a different direction, such as away from the bridge and/or the clamp.

Hinge 564 is operably coupled to compartment 528. Such coupling can be internal to compartment 528, such as within an inner chamber of compartment 528, and/or external to compartment 528, such as below portion 526. Further, note that such coupling can also be to the bridge, such as when the bridge and portion 526 are flush. Hinge 564 is also operably coupled to lid 518. Such coupling can be to a bottom side of lid 517 and/or a top side of lid 518. Note that such coupling can also be to a sidewall of lid 518.

Compartment 528 includes a button 566. Button 566 is configured for releasing lid 518 from a locked position to an unlocked position for pivoting toward the bridge. Button 566 is positioned above spine 530 diametrically opposing the bridge, but can be positioned elsewhere on compartment 528, such as perpendicular to the bridge adjacent to compartment 534. Button 566 can also be adjacent to hinge 564, below hinge 564. Button 566 is circular, but can have a different shape, such as a triangle, a parallelogram, and so forth. When lid 518 is pivotally closed, button 566 can be configured to output a sound indicative to a successful locking of lid 518. Note that other mechanisms for releasing lid 518 are possible as well, such as a latch or a J-hook. Further, note that in some embodiments, compartment 528 lacks button 566 and lid 518 is configured for unlocking release to open pivotally based on pressing force application onto lid 518.

The description of the present disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure. The scope of the present disclosure is defined by the claims, which includes known equivalents and unforeseeable equivalents at the time of filing of the present disclosure.

The invention claimed is:

1. An accessory, comprising:

a clamp; and a trash container that is coupled to the clamp and comprises at most two compartments including an upper compartment and a lower compartment, a lid and a single pivot, the upper compartment having an upper compartment base, an opening extending through the upper compartment base and an upper compartment sidewall extending from the upper compartment base and being delimited at a same height at a distal end thereof, the upper compartment sidewall having an upper compartment exterior surface extending continuously about an outer surface of a first portion of the trash container and an upper compartment interior surface extending continuously about and delimiting an inner surface of the upper compartment sidewall, the upper compartment interior surface and the upper compartment base defining an upper compartment interior chamber, the lower compartment including a lower compartment base having a first surface and a second surface being mirror opposite the first surface and a lower compartment sidewall extending continuously about an entirety of the lower compartment from the lower compartment base and being delimited at a same height at a distal end thereof, the lower compartment sidewall having a lower compartment exterior surface extending continuously about an outer surface of the lower compartment sidewall and a lower compartment interior surface extending continuously about and delimiting an inner surface of the lower compartment sidewall, the lower compartment interior surface and the first surface of the lower compartment base defining a lower compartment interior chamber, the upper compartment exterior surface and the lower compartment exterior surface together defining an outer periphery of the trash container that is entirely exposed to an external environment with the second surface of the base of the lower compartment defining an outer periphery of a proximal end of the trash container that is entirely exposed to an external environment, the lid delimited at an outer periphery that extends uninterrupted continuously thereabout to completely cover the distal end of the upper compartment in a closed position, and the lid rotatably coupled to the upper compartment to define an outer periphery of the container in conjunction with the upper compartment and the lower compartment, and the pivot extending from the lower compartment to the upper compartment along the upper compartment sidewall entirely within a first spline and the lower compartment sidewall entirely within a second spline such that the first spline and the second spline fully encompass the pivot along the upper compartment sidewall and the lower compartment sidewall, at least one of the upper compartment and the lower compartment is pivotable between a first position and a second position, both the first compartment and the second compartment being independently pivotable of each other with the upper compartment chamber being in fluid communication with the lower compartment chamber through the opening in the first position and contactable with the lower compartment chamber and the lower compartment chamber interior chamber being accessible in the second position.

2. The accessory of claim 1, wherein the clamp includes a jaw and a fastener configured for fastening through the jaw to tighten a clamping grip.

3. The accessory of claim 1, wherein the lid is pivotable about a vertical axis and faces the opening when the lid is closed.

4. The accessory of claim 3, wherein the lid defines a finger groove thereon.

5. The accessory of claim 3, wherein at least one of the upper compartment sidewall and the lid is at least partially at least one of transparent and translucent.

6. The accessory of claim 1, wherein the lid is pivotable between a first position wherein the lid is contactable with a distal end of the upper compartment sidewall, delimiting the upper compartment interior chamber and a second position wherein the lid is rotatable away from the upper compartment interior chamber.

7. The accessory of claim 6, wherein the upper compartment sidewall includes a button that is configured to permit the lid to move from the first position to the second position.

8. The accessory of claim 7, wherein the button and the clamp are diametrically opposed to each other and the lid is configured to open toward the clamp.

9. The accessory of claim 6, wherein at least one of the upper compartment sidewall and the lid is at least partially at least one of transparent and translucent.

10. The accessory of claim 1, wherein the lower compartment is configured to contain a case storing a plurality of trash bags coupleable to each other, wherein at least one of the bags is configured for extension from the lower compartment into the upper compartment through the opening.

11. The accessory of claim 10, wherein the opening is configured to decouple the bags from each other.

12. The accessory of claim 1, wherein the trash container is configured to rotate with respect to the clamp.

13. The accessory of claim 1, wherein the clamp is a spring-clamp.

14. The accessory of claim 1, wherein the clamp is fixed to the upper compartment of the trash container.

15. The accessory of claim 1, wherein the trash container comprises a spine protruding along the upper compartment sidewall and the lower compartment sidewall and the pivot extends through the spine along the upper compartment sidewall and the lower compartment sidewall.

16. The accessory of claim 1, wherein the upper compartment sidewall and the lower compartment sidewall are coplanar.

17. The accessory of claim 1, wherein the upper compartment interior chamber is volumetrically greater than the lower compartment interior chamber.

18. The accessory of claim 1, wherein at least one of the lower compartment sidewall and the lower compartment base is solid.

* * * * *